US008459484B2

(12) United States Patent
Ravelo

(10) Patent No.: US 8,459,484 B2
(45) Date of Patent: Jun. 11, 2013

(54) DRINK CONTAINER WITH AUTOMATICALLY EXTENDING STRAW

(76) Inventor: Raul Ravelo, Miami, FL (US)

( * ) Notice: Subject to any disclaimer, the term of this patent is extended or adjusted under 35 U.S.C. 154(b) by 118 days.

(21) Appl. No.: 13/008,912

(22) Filed: Jan. 19, 2011

(65) Prior Publication Data

US 2011/0108560 A1 May 12, 2011

Related U.S. Application Data

(63) Continuation-in-part of application No. 12/229,907, filed on Aug. 28, 2008, now abandoned.

(51) Int. Cl.
*B65D 77/28* (2006.01)

(52) U.S. Cl.
USPC ..... 220/210; 220/709; 220/705; 229/103.1; 215/388

(58) Field of Classification Search
USPC ..... 215/229, 388, 389; 220/705–710; 229/103.1; 239/33; 426/85; D7/300.2
See application file for complete search history.

(56) References Cited

U.S. PATENT DOCUMENTS 2,094,268 A * 9/1937 Friedman ..... 239/33
2,582,865 A * 1/1952 Gourgues ..... 126/262
2,710,108 A * 6/1955 Zarra ..... 215/320
3,295,715 A * 1/1967 Pugh ..... 220/212
3,542,278 A * 11/1970 Deaver ..... 229/103.1
3,547,308 A * 12/1970 Gilliem ..... 220/705
3,596,829 A * 8/1971 Gardner ..... 229/123.2
3,656,654 A * 4/1972 Brinkley, III ..... 220/706
3,980,210 A * 9/1976 Kligerman ..... 222/456
4,226,356 A * 10/1980 Lemelson ..... 220/270
4,228,913 A * 10/1980 Mack et al. ..... 220/710
4,247,016 A * 1/1981 Shaw ..... 220/708
4,305,521 A * 12/1981 Komatsuta et al. ..... 220/706
4,356,927 A * 11/1982 Cooper et al. ..... 220/710
4,442,948 A * 4/1984 Levy et al. ..... 220/710
4,582,213 A * 4/1986 Park et al. ..... 220/707
4,709,829 A * 12/1987 Johnson et al. ..... 220/706
4,712,702 A * 12/1987 Ayabe et al. ..... 220/706
4,735,329 A * 4/1988 Le ..... 215/229
4,811,860 A * 3/1989 Sorenson et al. ..... 220/380
4,826,034 A * 5/1989 Forbes ..... 220/705
4,892,187 A * 1/1990 Stein ..... 220/706
4,923,083 A * 5/1990 Forbes ..... 220/705
4,923,084 A * 5/1990 Forbes ..... 220/705
4,948,008 A * 8/1990 Wu et al. ..... 220/212
5,188,283 A * 2/1993 Gu ..... 229/103.1
5,211,298 A * 5/1993 Bloch ..... 215/11.1
5,439,125 A * 8/1995 Bloch ..... 215/229

(Continued)

*Primary Examiner* — J. Gregory Pickett
*Assistant Examiner* — Ned A Walker
(74) *Attorney, Agent, or Firm* — Robert M. Schwartz

(57) ABSTRACT

A system for aiding in drinking from a drink container is provided. The system includes a spring-style, flexible straw located inside a drink container such that when the container is closed the straw is compressed. A lever located on the exterior top portion of the container can be used to produce a circular orifice in the top of the container. When the container is opened via the circular orifice, the straw automatically extends through the orifice in the top of the container, thereby allowing a person to use the straw to drink the liquid in the container. Whereas the lower portion of the straw is spirally shaped like a spring mechanism, the upper portion of the straw is straight and an accordion mechanism is located at a base of the upper portion to allow the consumer to bend the straw when sipping from the straw.

6 Claims, 3 Drawing Sheets

U.S. PATENT DOCUMENTS 5,482,202 A * 1/1996 Wen ..... 229/103.1
5,503,296 A * 4/1996 DiBaggio ..... 220/708
5,586,681 A * 12/1996 Policappelli ..... 220/674
5,782,404 A * 7/1998 Robichaud et al. ..... 229/103.1
5,823,422 A * 10/1998 Collier et al. ..... 229/103.1
6,000,573 A * 12/1999 Murphy et al. ..... 220/710
6,076,729 A * 6/2000 Cornell et al. ..... 229/103.1
6,168,042 B1 * 1/2001 Kalagian ..... 220/705
6,264,057 B1 * 7/2001 Kim ..... 220/706
6,321,977 B1 * 11/2001 Lee ..... 229/103.1
6,336,566 B1 * 1/2002 Lipson ..... 215/388
6,443,324 B1 * 9/2002 Buntain ..... 220/705
6,745,949 B2 * 6/2004 Lee ..... 239/33
6,945,425 B1 * 9/2005 Kim ..... 220/706
7,392,916 B1 * 7/2008 Kuighadush ..... 220/707
2002/0043513 A1 * 4/2002 Lipson ..... 215/388
2002/0114543 A1 * 8/2002 Murray ..... 383/202
2003/0116574 A1 * 6/2003 Buntain ..... 220/710
2004/0164174 A1 * 8/2004 Day ..... 239/33
2006/0180593 A1 * 8/2006 White ..... 220/705
2008/0237246 A1 * 10/2008 Choi ..... 220/705

* cited by examiner

SECTION A-A OF FIG.1A

SECTION B-B OF FIG.1

SECTION C-C OF FIG.3

DRINK CONTAINER WITH AUTOMATICALLY EXTENDING STRAW

CROSS-REFERENCE TO RELATED APPLICATIONS

This patent application is a continuation-in-part of, and claims priority to, patent application Ser. No. 12/229,907 filed Aug. 28, 2008 now abandoned. The subject matter of patent application Ser. No. 12/229,907 is hereby incorporated by reference herein in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

This invention relates to the field of drink containers and more particularly to systems for aiding in drinking from drink containers.

BACKGROUND OF THE INVENTION

Conventional drink containers such as soda cans include a simple mechanism for opening an orifice in the can to allow a user to drink from the orifice. Typically, the conventional mechanism pushes a portion of the container into the can to create an orifice. There are some sanitary concerns, however, with pushing a portion of the container into the can, since the exterior of the can may not be completely clean. Also for sanitary reasons, some consumers prefer not to drink from an orifice in the can, since it requires that the consumer press his or her mouth to the container. One solution to this problem is shown in conventional juice box drinks that come with a straw used to drink the liquid in the container. This solution, however, requires that a separate straw package is opened and that the straw is manually inserted into the container. This process can be annoying to execute and can produce litter.

Therefore, a need exists to overcome the problems with the prior art as discussed above, and particularly for an improved system for drinking from a drink container.

SUMMARY OF THE INVENTION

Briefly, according to an embodiment of the present invention, a system for aiding in drinking from a drink container is provided. The system includes a spring-style, flexible straw located inside a drink container such that when the container is closed the straw is compressed. A lever located on the exterior top portion of the container can be used to produce a circular orifice in the top of the container. When the container is opened via the circular orifice, the straw automatically extends through the orifice in the top of the container, thereby allowing a person to use the straw to drink the liquid in the container. Whereas the lower portion of the straw is spirally shaped like a spring mechanism, the upper portion of the straw is straight and an accordion mechanism is located at a base of the upper portion to allow the consumer to bend the straw when sipping from the straw.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings.

DETAILED DESCRIPTION

Figure 1A:
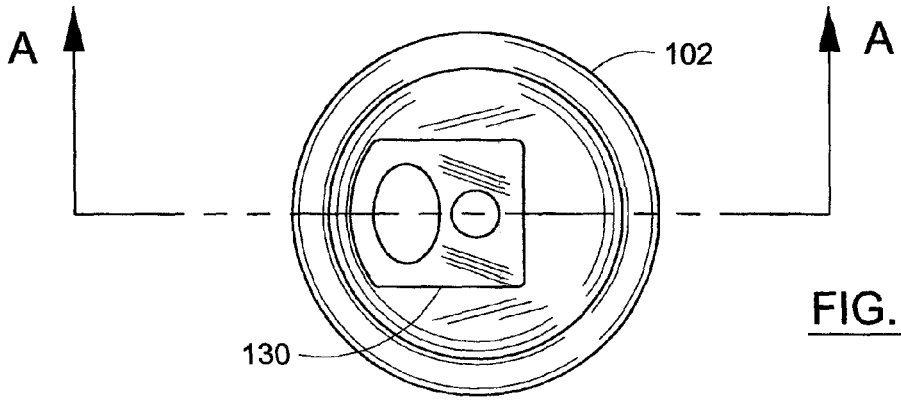
FIG. 1 is an illustration of a side view of a drink container showing its internal components, in accordance with one embodiment of the present invention.
Figure 1:
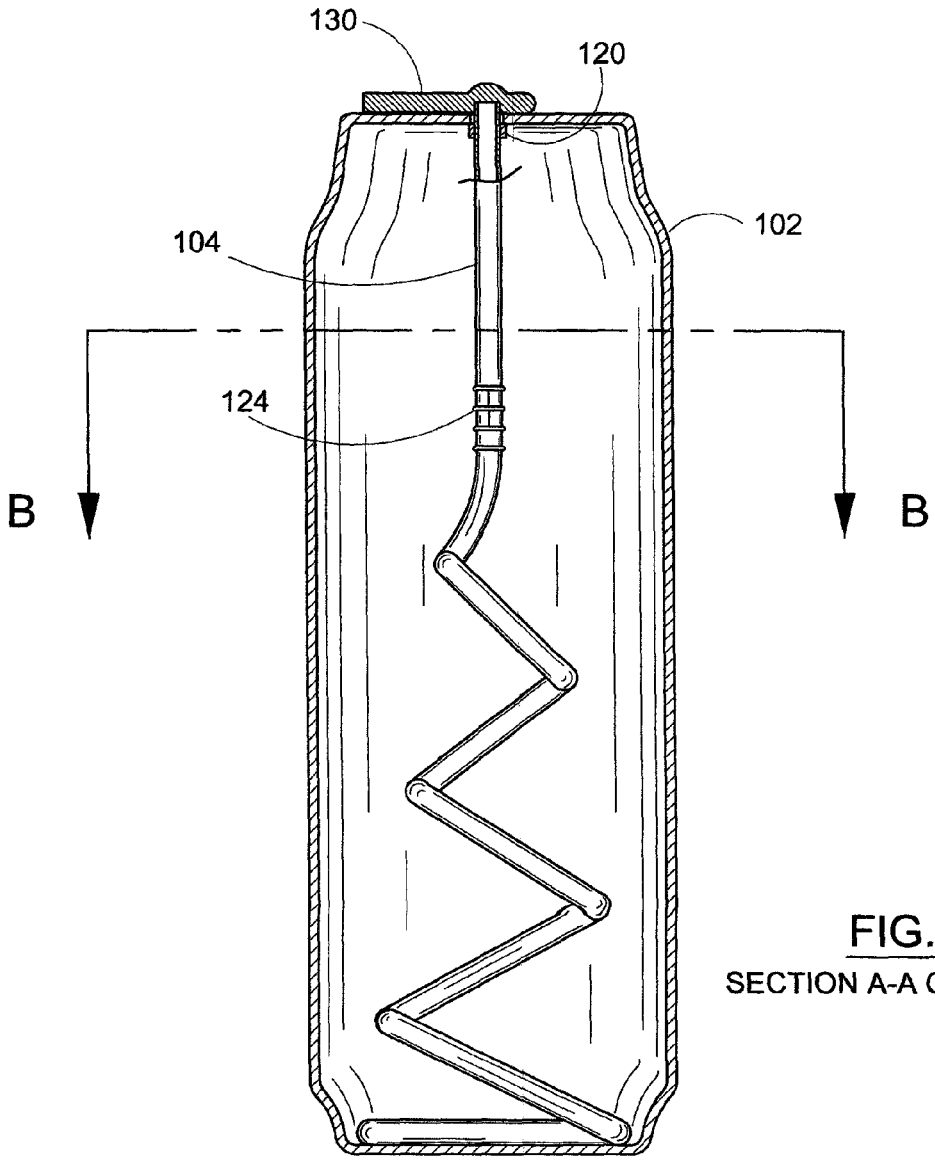

FIG. 1 is an illustration of a side view of a drink container 102 showing its internal components, in accordance with one embodiment of the present invention. Drink container 102 may comprise a cylindrical aluminum soft drink can, a carton of milk or a juice bottle. The container 102 includes a spring-style, flexible straw 104 that is compressed within the container 102.

The straw 104 is spirally shaped like a spring and compressed in a vertical arrangement within the container 104 such that a top end of the straw exerts pressure upon a top of the container and a bottom end of the straw exerts pressure upon a bottom of the container. The straw 104 is further conically shaped such that the spiral shape of the straw has a uniformly decreasing radius from the bottom end of the straw to the top end of the straw. The straw further comprises a straight portion 114 near the top end of the straw that extends vertically upwards, wherein the straight portion is positioned along a central axis of the spiral shape of the straw. The straw further comprises an accordion mechanism 124 at a base of the straight portion 114 so as to allow the straw to bend at the accordion mechanism 124.

FIG. 1 also shows a circular collar 120 located on a bottom-facing side of the top of the container, wherein the top end of the straw 104 extends into the collar 120. FIG. 1 further shows a lever 130 located on the top of the container, wherein the lever 130 comprises a rectangular shaped planar element having a top side and a bottom side.

Figure 2:
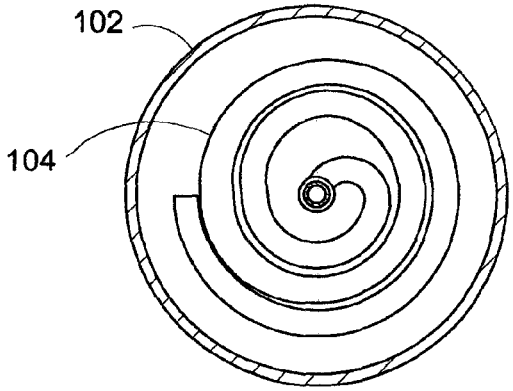
FIG. 2 is an illustration of a top view of the drink container of FIG. 1, showing its internal components.

FIG. 2 is an illustration of a top view of the drink container 102 of FIG. 1, showing its internal components. FIG. 2 shows the spiral shaped straw 104 compressed within the container 102.

Figure 3:
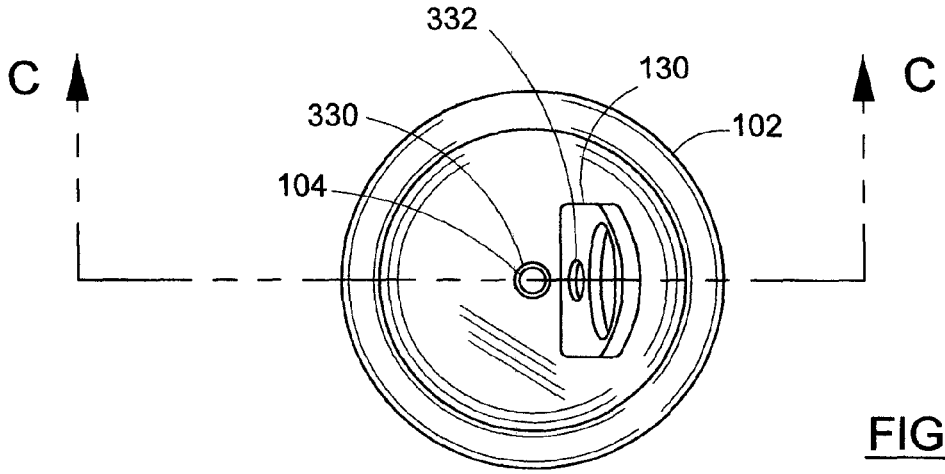
FIG. 3 is an illustration of a top view of the drink container of FIG. 1 in an open state, showing its external surfaces.

FIG. 3 is an illustration of a top view of the drink container 102 of FIG. 1 in an open state, showing its external surfaces. FIG. 3 shows the lever 130 located on the top of the container 102 is opened, revealing an orifice 330 in the center of the top of the container 102. The lever 130 is coupled with a removable cap 332, which is a circular removable cap 332 located in the top of the container 102 and directly above the collar 120. The lever 130 is hinged on one end to the top of the container 102, wherein the bottom side of the lever 130 is coupled with a top side of the removable cap 332. When the lever 130 is opened via upward force upon the lever 130, it causes the lever 130 to pivot about the hinge and remove the removable cap 332 from the top of the container 102, thereby creating an orifice 330 in the top of the container 102 and allowing the top end of the straw 104 to extend through the collar 120 and out of the container 102.

Figure 4:
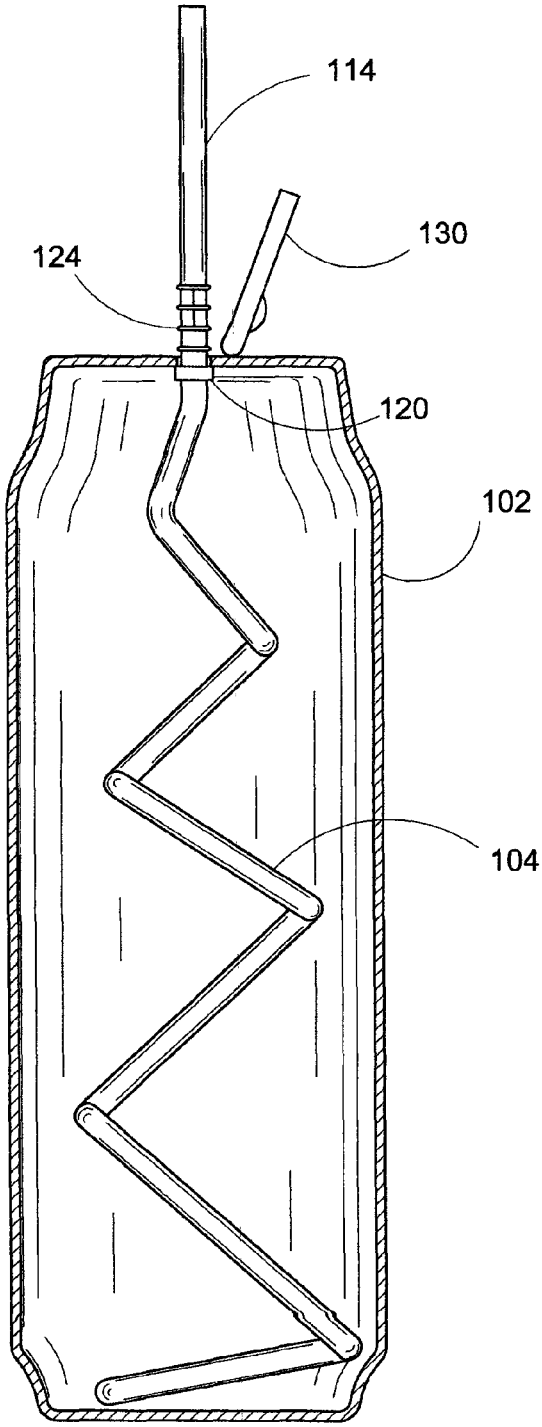
FIG. 4 is an illustration of a side view of the drink container of FIG. 1 in an open state, showing its internal components.

FIG. 4 is an illustration of a side view of the drink container 102 of FIG. 1 in an open state, showing its internal components. FIG. 4 shows the lever 130 located on the top of the container 102 is opened, allowing the top end of the straw 104 to extend through the collar 120 and out of the container 102. The straight portion 114 of the straw 104 extends outside of the container 102, as well as the accordion mechanism 124 at the base of the straight portion 114, thereby allowing a consumer to bend the straw 102 to drink from it.

Note there is no separate package that must be opened to access the straw 104, since it is located with the container 102. Further, the straw 102 does not require manual manipulation, thereby reducing the risk of sanitary contamination. Further, the use of a straw eliminates the need to touch the container to a consumer's mouth, thereby eliminating or reducing the risk of sanitary contamination. Further, for safety reasons, the present invention does not allow a child, elderly or disabled person to introduce a body part into the container once its opened, since the straw obstructs the orifice 330. Lastly, the present invention is environmentally friendly in that it does not contain packaging waste associated with having an exterior, packaged straw. Also, since the straw is located within the container, it is easily retained in the container for later reclamation for recycling.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

The invention claimed is:

1. A system for aiding a user in drinking from a container, comprising:

a cylindrical container for holding a liquid drink, the container comprising:

a circular-shaped top planar element, and a circular-shaped bottom planar element;

a straw comprising:

a first portion having a spiral portion acting as a spring and compressed within said container, and a second portion having:

a top end, an elongated linear portion, and an accordion straw bending mechanism provided proximal to a bottom end of said second portion;

a circular collar located on a bottom-facing side of said top planar element of said container, wherein said top end of said second portion of said straw extends into said collar;

a circular removable portion of said top planar element of said container, wherein said removable portion is located directly above said collar;

a lever located on an upwards-facing side of said top planar element of said container and coupled with said removable portion, wherein said lever comprises:

a rectangular shaped planar element having a top side and a bottom side, wherein said rectangular shaped planar element is hinged on a first end to said upwards-facing side of said top planar element of said container, and wherein said bottom side of said rectangular shaped planar element is coupled with an upwards-facing side of said removable portion; and, wherein when an upward force acts upon the lever, said rectangular shaped planar element pivots about said hinged end and removes said removable portion from said top planar element of the container, thereby creating an aperture in said top planar element of said container directly above said collar and allowing said first portion of said straw to release a stored spring energy to urge said second portion of said straw through said aperture a distance of at least one third of a length of said container.

2. The system in claim 1, wherein said accordion straw bending mechanism is defined by a plurality of horizontal lines, said accordion straw bending mechanism urged through said aperture by said first portion of said straw when said removable portion is removed.

3. The system in claim 2, where said user of the beverage may bend said straw to any desirable position.

4. The system in claim 3, wherein said container is an aluminum can.

5. The system in claim 4, wherein the collar comprises a circular shape located at the center of said top of said container.

6. The system in claim 5, wherein said circular removable portion is a cap, said cap having a diameter slightly larger than a diameter of said straw.

* * * * *